US008539650B2

(12) United States Patent
Kojima et al.

(10) Patent No.: US 8,539,650 B2
(45) Date of Patent: Sep. 24, 2013

(54) SLIDE FASTENER

(75) Inventors: Masayoshi Kojima, Toyoma (JP); Kenji Yuki, Toyama (JP)

(73) Assignee: YKK Corporation (JP)

( * ) Notice: Subject to any disclaimer, the term of this patent is extended or adjusted under 35 U.S.C. 154(b) by 175 days.

(21) Appl. No.: 13/144,235

(22) PCT Filed: Jan. 13, 2009

(86) PCT No.: PCT/JP2009/050306

§ 371 (c)(1),
(2), (4) Date: Jul. 12, 2011

(87) PCT Pub. No.: WO2010/082294

PCT Pub. Date: Jul. 22, 2010

(65) Prior Publication Data

US 2011/0265291 A1 Nov. 3, 2011

(51) Int. Cl.
*A44B 19/06* (2006.01)

(52) U.S. Cl.
USPC ..... 24/410

(58) Field of Classification Search
USPC ..... 24/403, 407–410, 413, 414
See application file for complete search history.

(56) References Cited

U.S. PATENT DOCUMENTS

| | | | | |
|---|---|---|---|---|
| 2,798,275 | A | 7/1957 | Morin | |
| 4,520,535 | A * | 6/1985 | Kasai | 24/410 |
| 2006/0260104 | A1 | 11/2006 | Himi | |

FOREIGN PATENT DOCUMENTS

| | | | |
|---|---|---|---|
| DE | 3315904 | A | 11/1983 |
| EP | 1723868 | A2 | 11/2006 |
| FR | 2526278 | A | 11/1983 |
| GB | 2119852 | A | 11/1983 |
| JP | 45-33956 | U | 12/1970 |
| JP | 47-37061 | A | 9/1972 |
| JP | 58-168208 | A | 11/1983 |
| JP | 2006-320642 | A | 11/2006 |
| JP | 2007-021023 | A | 2/2007 |

OTHER PUBLICATIONS

International Search Report and Written Opinion, PCT International Patent Application No. PCT/JP2009/050306, mailed Apr. 29, 2009.

* cited by examiner

*Primary Examiner* — James Brittain
(74) *Attorney, Agent, or Firm* — Kilpatrick Townsend & Stockton LLP

(57) ABSTRACT

A slide fastener where each fastener element includes an upper half element portion disposed at a first surface side of a fastener tape and a lower half element portion disposed at a second surface side of the fastener tape. The upper half element portion includes a first tape-sandwiching portion and a first head portion of a tapered form that extends from the first tape-sandwiching portion. The upper half element portion has a tapered portion that gradually decreases in a dimension between front and rear side surfaces, in the tape length direction, of at least the first tape-sandwiching portion as it goes upward. Each fastener element can be lightweight, and the fastener element can look like a metal fastener element.

9 Claims, 7 Drawing Sheets

SLIDE FASTENER

This application is a national stage application of PCT/JP2009/050306, which is incorporated herein by reference.

TECHNICAL FIELD

The invention relates to a slide fastener in which a plurality of synthetic resin fastener elements are lined along opposing tape side edge portions of a pair of left and right fastener tapes by injection molding, and more particularly, to a slide fastener having a shape in which each synthetic resin fastener element looks like a metal fastener element.

BACKGROUND ART

Conventionally, as a fastener element used in a slide fastener, there have been known synthetic resin fastener elements, each being individually formed by performing injection molding of synthetic resin on a fastener tape, continuous fastener elements formed by forming monofilament in a coil shape or a zigzag shape, metal fastener elements formed by swaging a Y-shaped metal element material onto a fastener tape, or the like.

The synthetic resin fastener elements are usually formed to straddle a fastener so as to be disposed on a first surface as an outer surface of the fastener tape and a second surface as a tape back surface. The synthetic resin fastener elements include an upper half element portion arranged on the first surface side of the fastener tape and a lower half element portion arranged on the second surface side of the fastener tape.

The synthetic resin fastener element is mostly formed such that the upper half element portion and the lower half element portion have symmetrical shapes, but there is a case in which the upper half element portion and the lower half element portion are asymmetrically formed in different shapes, for example, in order to improve the appearance, the feel (the touch), or the like of the slide fastener.

Examples of the fastener elements in which the upper half element portion and the lower half element portion have shapes different from each other are disclosed, for example, in Japanese Utility Model Application Publication No. 45-33956 (Patent Document 1), Japanese Patent Application Publication No. 47-37061 (Patent Document 2), Japanese Patent Application Laid-Open No. 2006-320642 (Patent document 3), and the like.

For example, a synthetic resin fastener element 51 described in Patent Document 1 includes an upper half element portion 53 arranged on a first surface side of a fastener tape 52 and a lower half element portion 54 arranged on a second surface side of the fastener tape 52 as illustrated in FIG. 12. The upper half element portion 53 includes a first tape-sandwiching portion 53*a* having a nearly rectangular shape in the front view and a triangular head 53*b* that extends from the first tape-sandwiching portion 53*a* toward the outside of the tape and is formed in a triangular shape in which a dimension in a tape length direction (hereinafter, this dimension is referred to as an element width dimension) gradually decreases toward the forefront thereof.

The lower half element portion 54 of the fastener element 51 includes a second tape-sandwiching portion that sandwiches the fastener tape 52 together with the first tape-sandwiching portion 53*a*, a neck 54*a* that extends from the second tape-sandwiching portion toward the outside of the tape and has a shape that is constricted in the element width direction, and a coupling head 54*b* that extends from the forefront of the neck 54*a* to be shaped like a bulge.

Particularly, in the fastener element 51 of Patent Document 1, an upper surface of the upper half element portion 53 and a lower surface of the lower half element portion 54 are continuous flat surfaces, and the triangular head 53*b* of the upper half element portion 53 is set to be thinner in thickness (dimension of the vertical direction) than the coupling head 54*b* of the lower half element portion 54.

According to Patent Document 1, since a slide fastener 50 is configured by using the above-described fastener element 51, the entire thickness of the fastener element 51 can be reduced. Further, since part of the coupling head 54*b* of the other coupling party can be covered with a side edge portion of the triangular head 53*b*, strong coupling to the extent that chain breaking is difficult to occur is obtained.

Next, a synthetic resin fastener element 61 described in Patent Document 2 includes an upper half element portion 62 and a lower half element portion 63 as illustrated in FIGS. 13 and 14. The upper half element portion 62 of each fastener element 61 has a nearly trapezoidal shape when viewed from the front and includes a first tape-sandwiching portion 62*a* that sandwiches a fastener tape together with the lower half element portion 63, a neck 62*b* that extends from the first tape-sandwiching portion 62*a* toward the outside of the tape, and a coupling head 62*c* that extends from a forefront of the neck 62*b* to form a bulge shape. In Patent Document 2, the coupling head 62*c* of the upper half element portion 62 is formed to have a cross section of a semicircular shape.

Meanwhile, the lower half element portion 63 of the fastener element 61 includes only a second tape-sandwiching portion 63*a* arranged to correspond to the first tape-sandwiching portion 62*a* and the neck 62*b* of the upper half element portion 62. Below the coupling head 62*c* of the upper half element portion 62, a space with nothing formed is present.

In the slide fastener 60 of Patent Document 2 having the above-described fastener element 61, since the coupling head 62*c* of the upper half element portion 62 has a semicircular cross section, the fastener tape 64 can be easily bent toward the upper half element portion 62 side at a small curvature in a state in which the left and right fastener elements 61 are coupled. According to Patent Document 2, a tape inner side edge portion of the first tape-sandwiching portion 62*a* in each fastener element 61 is formed to have a larger width than the coupling head 62*c*, and thus coupling of the left and right fastener elements 61 can be prevented from coming loose in the bending state of the fastener tape 64.

A synthetic resin fastener element 71 described in Patent Document 3 has an upper half element portion 72 and a lower half element portion 73 as illustrated in FIG. 15. The upper half element portion 72 of each fastener element 71 includes a first tape-sandwiching portion 72*a* having a nearly rectangular shape when viewed from the front and a triangular head 72*b* that extends from the first tape-sandwiching portion 72*a* toward the outside of the tape and is formed in a triangular shape in which an element width dimension gradually decreases toward the forefront.

The lower half element portion 73 of the fastener element 71 includes a second tape-sandwiching portion 73*a* that sandwiches a fastener tape 74 together with the first tape-sandwiching portion 72*a*, a neck 73*b* that extends from the second tape-sandwiching portion 73*a* toward the outside of the tape, and a coupling head 73*c* that extends from a forefront of the neck 73*b* to form a bulge shape.

Further, in the fastener element 71, an upper surface of the upper half element portion 72 is formed to be curved such that a central portion in an element width direction and a central portion in an element length direction can protrude upward. Meanwhile, a lower surface of the lower half element portion 73 is formed to be a flat plane surface.

In a slide fastener 70 having the fastener element 71 of Patent Document 3, the upper surface of the upper half element portion 72 has the curved surface that bulges in the form of a gentle circular arc, and thus the feel or the touch of the fastener element 71 can be improved, and the appearance of the element row can be improved.

Patent Document 1: Japanese Utility Model Application Publication No. 45-33956

Patent Document 2: Japanese Patent Application Publication No. 47-37061

Patent Document 3: Japanese Patent Application Laid-Open No. 2006-320642

DISCLOSURE OF INVENTION

Problem to be Solved by the Invention

The above-described synthetic resin fastener elements are fixed directly to the fastener tape at the time of injection molding. Thus, by increasing an area of the fastener element fixed to the fastener tape, fixing strength of the fastener element increases, and a fixing state of the fastener element is stabilized. For this reason, in the conventional synthetic resin fastener elements described in Patent Documents 1 to 3, in order to stably secure the fixing strength of the fastener element, the element width dimension of each fastener element has been forced to be set to a large value.

Meanwhile, the metal fastener element used in the slide fastener is implanted into and fixed to the fastener tape by swaging. Thus, even if the element width dimension of the fastener element is not set to a large value like the above-described synthetic resin fastener element, sufficient fixing strength can be easily obtained.

For this reason, the element width dimension of the metal fastener element is usually set to a value smaller than the synthetic resin fastener element. The slide fastener to which the metal fastener element is fixed mostly looks more stylish or gives a more snazzy impression compared to the slide fastener having the synthetic resin fastener element and thus is excellent in quality of appearance (visual quality).

However, the metal fastener element weighs more than the synthetic resin fastener element, and thus the slide fastener in which a plurality of metal fastener elements are lined is heavy. Therefore, there has been a problem in that the slide fastener having the metal fastener element is difficult to be used in clothing that requires lightness regardless of excellence in quality of appearance, and thus its use is limited.

The invention is made in light of the forgoing conventional problems, and it is a specific object of the invention to provide a slide fastener that has a fastener element that is excellent in quality of appearance like the metal slide fastener element and weighs less than the metal fastener element, particularly, a slide fastener that is also excellent in functionality such that coupling breaking is difficult to occur.

Means for Solving the Problem

In order to achieve the above described object, as a basic configuration, the main characteristic of a slide fastener provided by this invention includes: a pair of left and right fastener tapes; and a plurality of synthetic resin fastener elements lined along opposing tape side edge portions of the fastener tapes, wherein each fastener element includes an upper half element portion disposed at a first surface side of the fastener tape and a lower half element portion disposed at a second surface side of the fastener tape, the upper half element portion includes a first tape-sandwiching portion having a predetermined dimension in a tape length direction, and a first head portion of a tapered form that extends from the first tape-sandwiching portion toward an outside of the tape up to a forefront of the lower half element portion and has a dimension in the tape length direction that gradually decreases toward the forefront, the lower half element portion includes a second tape-sandwiching portion that sandwiches the fastener tape together with the first tape-sandwiching portion, a neck that extends from the second tape-sandwiching portion toward the outside of the tape and has a shape constricted in a front and rear of the tape length direction, and a second head portion that extends from a forefront portion of the neck and bulges in a front and rear of the tape length direction, wherein the upper half element portion has a tapered portion in which a dimension between front and rear side surfaces of at least the first tape-sandwiching portion in the tape length direction gradually decreases as it goes upward.

In the slide fastener according to this invention, it is preferable that the upper half element portion include an interference avoiding portion configured to avoid interference between the first head portion and the upper half element portion of an other coupling party side in order to prevent adjacent second head portions of the other coupling party side from being separated until coupling gets loose by interference between the first head portion and the upper half element portion of the other coupling party side when the fastener tape is bent in a direction in which the upper half element portions get closer to each other in a state where the left and right fastener elements are coupled.

In this case, it is preferable that the interference avoiding portion be formed such that a thin walled portion in which a height dimension in a vertical direction of the fastener element is smaller than a height dimension of a thin walled start portion set on the upper half element portion is disposed from the thin walled start portion to the first head portion side.

In addition, it is preferable that the thin walled portion include a downward inclined surface that is inclined downward to gradually decrease in a height dimension of the fastener element toward a forefront of the first head portion from the thin walled start portion. Especially, it is preferable that in the upper half element portion, an inclination angle of the downward inclined surface thereof relative to the upper surface thereof, at a tape inner side which is further inside than the thin walled start portion, be set to be equal to or more than 20° and to be less than 90°.

Further, it is preferable that a height dimension of the fastener element at the forefront of the first head portion be set to be larger than 50% and to be equal to or less than 80% of a height dimension of the fastener element at a position where the thin walled start portion is disposed. Further more, it is preferable that a dimension of a tape width direction from the forefront of the first head portion to the thin walled start portion be set to be equal to or more than 45% of a length dimension of the whole fastener element.

Further, in the slide fastener of the invention, a tapered angle of the tapered portion in an element vertical direction is preferably set to 5° or more. Particularly, a maximum value of a dimension in the element width direction of an upper surface of the first tape-sandwiching portion is preferably set to be smaller than 70% of a maximum value of a dimension in the element width direction of the first tape-sandwiching portion.

Further, in the slide fastener of the invention, an internal angle in a forefront of the first head portion is preferably set to 30° or less. Further, a maximum value of the dimension in the element width direction of the second head portion is preferably set to be equal to or more than 85% and to be equal to or less than 95% of a maximum value of a dimension in the element width direction of the second tape-sandwiching portion.

Effect of the Invention

In the slide fastener according to the invention, the synthetic resin fastener element fixed to the fastener tape includes an upper half element portion and a lower half element portion. The upper half element portion includes a first tape-sandwiching portion and a first head portion of a tapered form that extends from the first tape-sandwiching portion to the tape outside. The lower half element portion includes a second tape-sandwiching portion, a neck having a constricted shape, and a second head portion having a bulging shape. In the upper half element portion has a tapered portion that gradually decreases in dimension between the front and rear side surfaces, in the tape length direction, of at least the first tape-sandwiching portion as it goes to the top.

The slide fastener of the invention having the above described synthetic resin fastener element can be made to weigh less than the slide fastener having the metal fastener element. Further, in the fastener element according to the invention, since the tapered portion is formed in the upper half element portion, an area fixed to the fastener tape increases, and thus fixing strength of the fastener element can increase, and the dimension in the tape length direction of the upper surface of the upper half element portion (that is, the element width dimension) can decrease. Thus, the fastener element can have excellent quality of appearance that gives a stylish feeling or a snazzy impression like the metal fastener element.

In the slide fastener of the invention, the upper half element portion includes an interference avoiding portion for avoiding interference between the first head portion and the upper half element portion of the other coupling party side when the fastener tape is bent in a direction in which the upper half element portions get closer to each other in a state in which the left and right fastener elements are coupled.

For example, in the case of the slide fastener having the conventional synthetic resin fastener element in which the tapered portion of the invention has not been disposed in the first tape-sandwiching portion of the fastener element, the upper half element portion of each fastener element is widely formed in the tape length direction (the element width direction), and a gap between the adjacent fastener elements at the element upper surface side is set to be relatively small.

For this reason, when the fastener tape is bent in a direction in which the upper half element portions get closer to each other in a state in which the left and right fastener elements are coupled, that is, in a state in which the lower half element portions of the left and right fastener elements are coupled, if the fastener tape is bent at up to a certain curvature, the front side edge portion and the rear side edge portion of the adjacent fastener elements come into contact with each other at the upper surface side of the first tape-sandwiching portion.

For this reason, the fastener tape is regulated to be bent at a curvature smaller than it. As a result, a gap between the second head portions of the adjacent lower half element portions at the second surface side of the fastener tape is not likely to be larger than a predetermined size, it is possible to prevent coupling of the left and right fastener elements from becoming loose.

However, in the case of the slide fastener in which the tapered portion is formed in the first tape-sandwiching portion of the fastener element as in the invention, a pitch of the fastener elements fixed to the fastener tape is not different from that of the conventional art, but the dimension in the tape length direction of the upper surface portion of the first tape-sandwiching portion of each fastener element decreases. For this reason, a gap between the adjacent fastener elements at the element upper surface side inevitably becomes larger than that of the conventional slide fastener.

For this reason, in the slide fastener of the invention, when the fastener tape is bent in a direction in which the upper half element portions get closer to each other in a state in which the lower half element portions of the left and right fastener elements are coupled, the fastener tape is easily bent at up to a curvature smaller than that of the conventional slide fastener. At this time, between the adjacent fastener elements, before the first tape-sandwiching portions come into contact with each other, the first head portion of the upper half element portion and the upper half element portion of the other coupling party side interfere with each other.

If the first head portion of the upper half element portion and the upper half element portion of the other coupling party side interfere each other when the fastener tape in the slide fastener of the invention is bent at up to the curvature smaller than the conventional art as described above, since the interfered portion becomes a supporting point and the lower half element portions of the adjacent fastener elements of the other coupling party side turn in the separation direction, a gap between the second head portions of the fastener elements easily expands to be larger than a predetermined size. As a result, the coupling state of the left and right lower half element portions cannot be maintained, and coupling of the left and right fastener elements gets loose, causing a problem called so-called chain breaking.

For such a reason, in the invention, in order to improve the problem of chain breaking caused when the tapered portion is formed in the first tape-sandwiching portion of the fastener element, the above described interference avoiding portion has been disposed in the upper half element portion.

As a result, when the fastener tape is bent in the state in which the left and right fastener elements are coupled, even if the fastener tape is bent at up to the curvature smaller than the conventional art, since it is possible to avoid the interference between the first head portion and the upper half element portion of the other coupling party side with a high degree of certainty, it is possible to prevent the fastener element from turning in the separation direction on the interfered portion functioning as the supporting point. As a result, the gap between the second head portions of the fastener elements does not expand to be larger than a predetermined size, it is possible to prevent coupling of the left and right fastener elements from getting loose, and the coupling state can be stably maintained.

In this case, the interference avoiding portion is provided by having a thin walled portion which is disposed from the thin walled start portion to the first head portion side and in which a height dimension in a vertical direction of the fastener element is smaller than a height in a thin walled start portion set on the upper half element portion. Thus, when the fastener tape is bent in the direction in which the upper half element portions get closer to each other in the coupling state of the fastener elements, it is possible to avoid the interference between the first head portion and the upper half element portion of the other coupling party side with a high degree of certainty.

At this time, the thin walled portion includes a downward inclined surface that is inclined downward to gradually reduce a height dimension of the fastener element toward a forefront of the first head portion from the thin walled start portion. Thus, the above described interference avoiding portion can be easily disposed in the upper half element portion without deteriorating the quality of appearance of the fastener element.

Particularly, in this case, in the upper half element portion, an inclination angle of the downward inclined surface thereof with respect to the upper surface, at a tape inner side which is further inside than the thin walled start portion, is set to be equal to or more than 15° and to be less than 90°, preferably, to be equal to or more than 20° and to be equal to or less than 45°. If the inclination angle is equal to or more than 15°, particularly, equal to or more than 20°, it is possible to avoid the interference between the first head portion and the upper half element portion of the other coupling party side through the interference avoiding portion with a high degree of certainty. Further, if the inclination angle is less than 90°, particularly, is equal to or less than 45°, the quality of appearance of the fastener element does not deteriorate.

Further, in the fastener element of the invention, a height dimension of the fastener element at the forefront of the first head portion is set to be larger than 50% and to be equal to or less than 80% of a height dimension of the fastener element at a position where the thin walled start portion is disposed.

If the height dimension in the forefront of the first head portion is set to be larger than 50% of the height dimension in the thin walled start portion, preferably to be equal to or more than 60%, since the first head portion is formed up to the forefront of the lower half element portion with a high degree of certainty, the quality of appearance of the fastener element does not deteriorate. Further, if the height dimension in the forefront of the first head portion is set to be equal to or less than 80% of the height dimension in the thin walled start portion, preferably to be equal to or less than 75%, it is possible to avoid the interference between the first head portion and the upper half element portion of the other coupling party side through the interference avoiding portion with a high degree of certainty.

Further, in the fastener element of the invention, a dimension in the tape width direction from the forefront of the first head portion to the thin walled start portion is set to be equal to or more than 45% of a length dimension of the whole fastener element. Thus, it is possible to avoid the interference between the first head portion and the upper half element portion of the other coupling party side through the interference avoiding portion with a higher degree of certainty.

Further, in the fastener element of the invention, a tapered angle of the tapered portion of each fastener element in an element vertical direction is set to be equal to or more than 5°, preferably to be equal to or more than 10°. Further, a maximum value of a dimension in a tape length direction (an element width dimension) of an upper surface of the first tape-sandwiching portion of each fastener element is set to be smaller than 70% of a maximum value of a dimension in a tape length direction of the first tape-sandwiching portion.

As the tapered angle of the tapered portion is set to be equal to or more than 5°, and the maximum value of the dimension in the tape length direction of the upper surface of the first tape-sandwiching portion is set to be smaller than 70% of the maximum value of the dimension in the tape length direction of the first tape-sandwiching portion, the dimension in the tape length direction of the upper surface side of the first tape-sandwiching portion decreases, and each fastener element fixed to the fastener tape can be finished with the appearance looking like the metal fastener element.

Further, the taped angle in the invention refers to an inclination angle of the tapered surface in the element vertical direction in a case where the tapered surface that configures the tapered portion is formed to be the flat surface and refers to an inclination angle of a tangential line in a lower end portion of a curved surface on the element vertical direction in a case where the tapered surface is formed to be the curved surface.

Further, in the slide fastener of the invention, an internal angle in the forefront of the first head portion is set to be equal to or less than 30°, preferably, equal to or less than 20°. Thus, the appearance of each fastener element can look more like the metal fastener element.

Further, a maximum value of a dimension in a tape length direction of the second head portion of each fastener element is set to be equal to or more than 85% and to be equal to or less than 95% of a maximum value of a dimension in a tape length direction of the second tape-sandwiching portion.

As the maximum value of the dimension in the tape length direction of the second head portion is set to be equal to or more than 85% of the maximum value of the dimension of the second tape-sandwiching portion, when the left and right fastener elements are coupled, sufficient coupling strength capable of enduring the use of the slide fastener can be stably obtained, and further, even if the fastener tape is bent in the state in which the left and right fastener elements are coupled, the occurrence of chain breaking can be prevented with a high degree of certainty.

As the maximum value of the dimension in the tape length direction of the second head portion is set to be equal to or less than 95% of the maximum value of the dimension of the second tape-sandwiching portion, the coupling movement can be smoothly performed, for example, when the left and right fastener elements are coupled by sliding the slider.

EXPLANATIONS OF LETTERS AND NUMERALS

Figure 1:
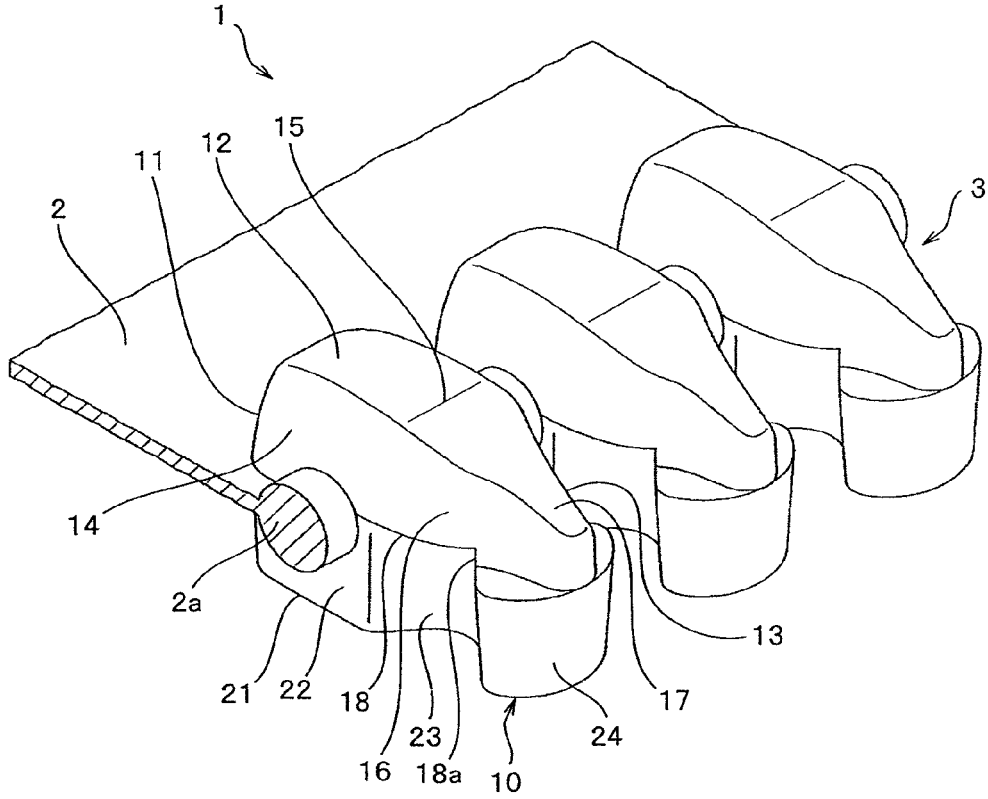
FIG. 1 is an enlarged main part perspective view illustrating a main part of a slide fastener according to a first embodiment of the invention.

1 slide fastener
2 fastener tape
2*a* core portion
3 element row
8 gap
10, 10' fastener element
11 upper half element portion
12 first tape-sandwiching portion
13, 13' first head portion
13*a* first narrow width portion
13*b* second narrow width portion
13*c* bend portion
14 tapered portion
15 thin walled start portion
16 thin walled portion
17 downward inclined surface
18 boundary portion
18*a* step portion
21 lower half element portion
22 second tape-sandwiching portion
23 neck
24 second head portion
30 fastener element
31 upper half element portion
32 first tape-sandwiching portion
33 first head portion
34 tapered portion
35 thin walled start portion
36 thin walled portion
37*a* first downward inclined surface
37*b* second downward inclined surface
40 fastener element
41 upper half element portion
42 first tape-sandwiching portion
43 first head portion
44 tapered portion
45 thin walled start portion
46 thin walled portion
47 downward inclined surface
48 flat surface
H1 height dimension of fastener element at position where thin walled start portion is arranged
H2 height dimension of fastener element at forefront of first head portion
L1 length dimension of whole fastener element
L2 dimension in tape width direction from forefront of first head portion to thin walled start portion
W1 maximum value of dimension in tape length direction in first and second tape-sandwiching portions
W2 maximum value of dimension in tape length direction in upper surface of first tape-sandwiching portion
W3 maximum value of dimension in tape length direction in second head portion
θ1, θ1' inclination angle of downward inclined surface
θ2 tapered angle
θ3 internal angle of forefront of first head portion

BEST MODE FOR CARRYING OUT THE INVENTION

Hereinafter, exemplary embodiment of the invention will be described in detail with reference to the accompanying drawing. The invention is not limited to the following embodiments, and various changes can be made as long as substantially the same configuration and the same function effect as in the invention are provided.

First Embodiment

Figure 2:
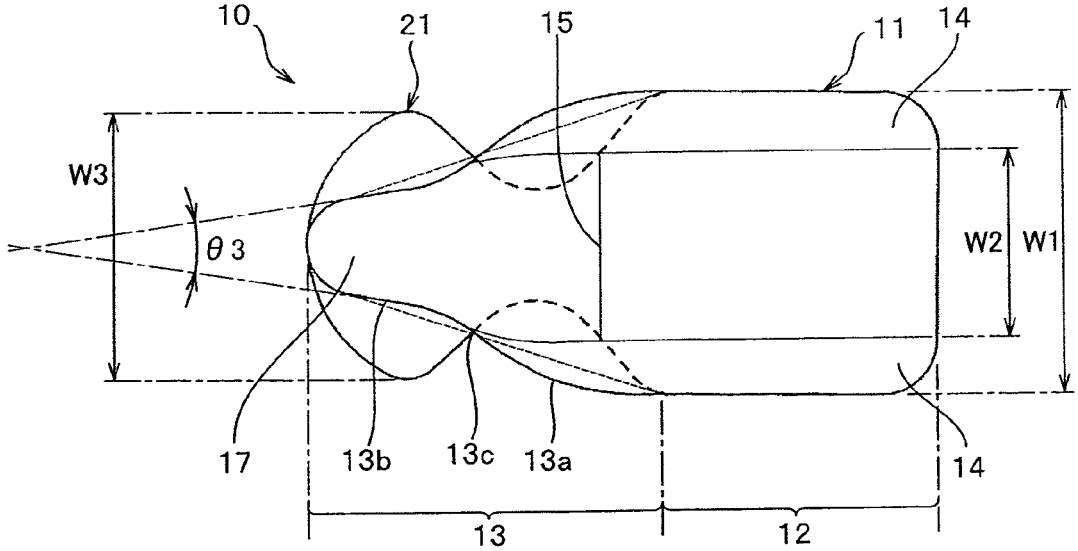
FIG. 2 is a top view in which the fastener element is viewed from the front of the slide fastener.
Figure 3:
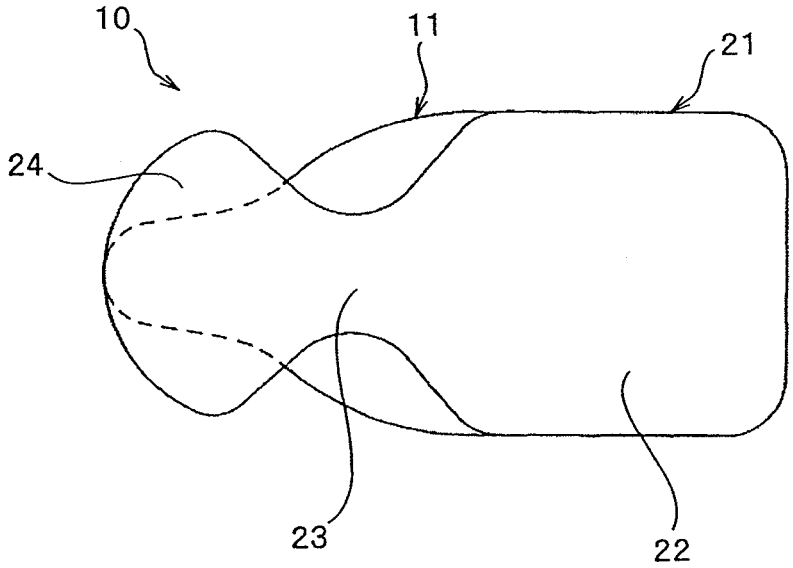
FIG. 3 is a bottom view in which the fastener element is viewed from the back of the slide fastener.
Figure 4:
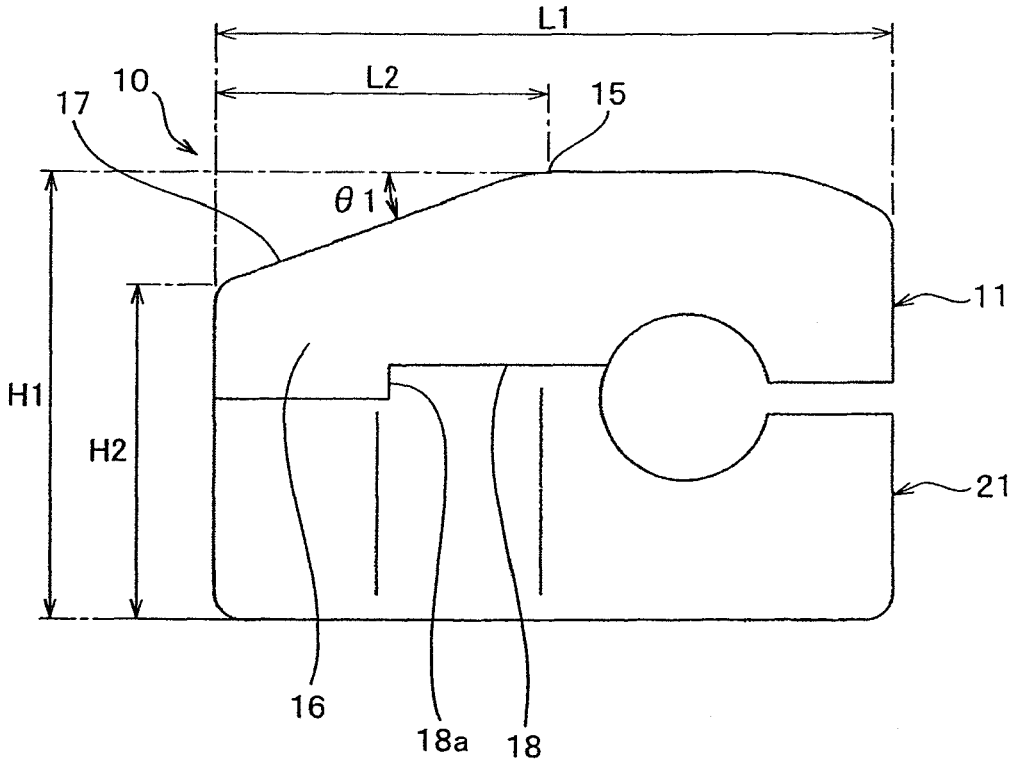
FIG. 4 is a side view in which the fastener element is viewed from the lower side of a tape length direction.
Figure 5:
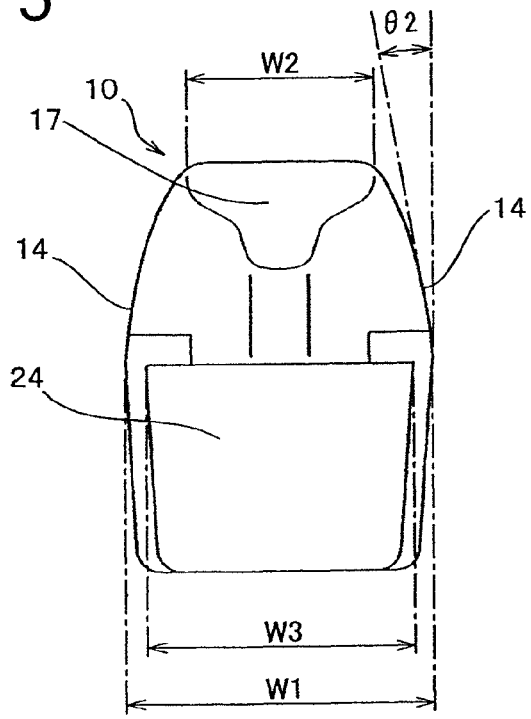
FIG. 5 is a view in which the fastener element is viewed from first and second head portion sides.
Figure 6:
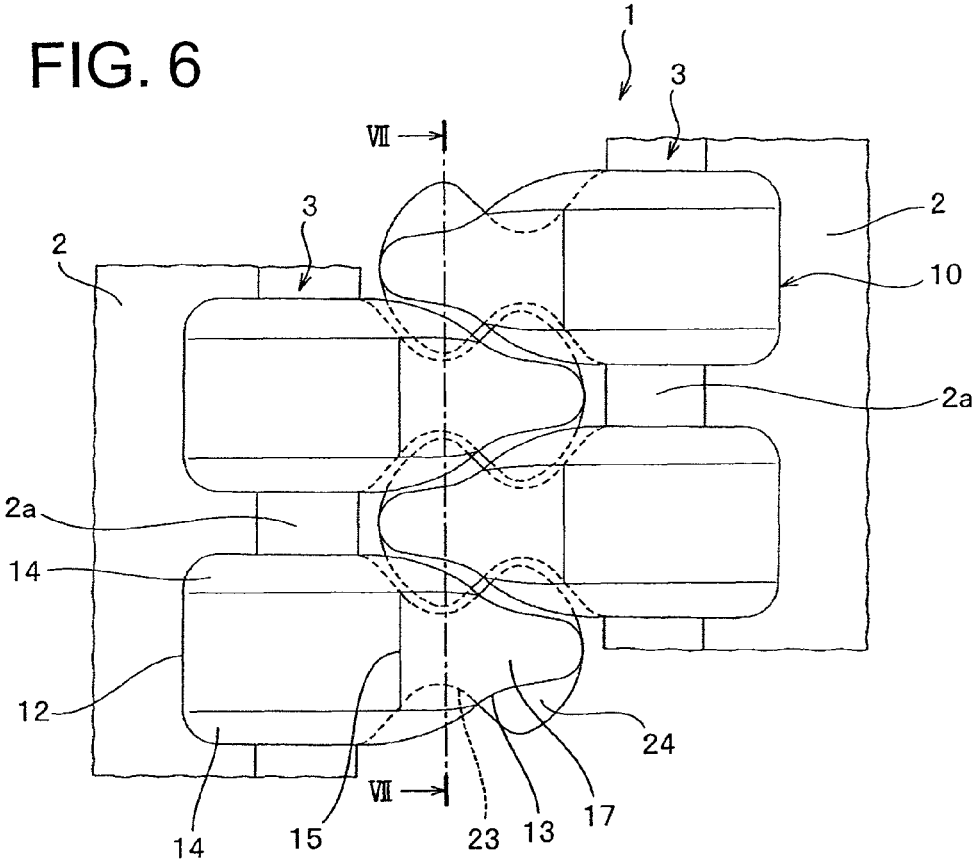
FIG. 6 is a front view illustrating a state in which left and right fastener elements of the slide fastener according to the first embodiment are coupled.
Figure 7:
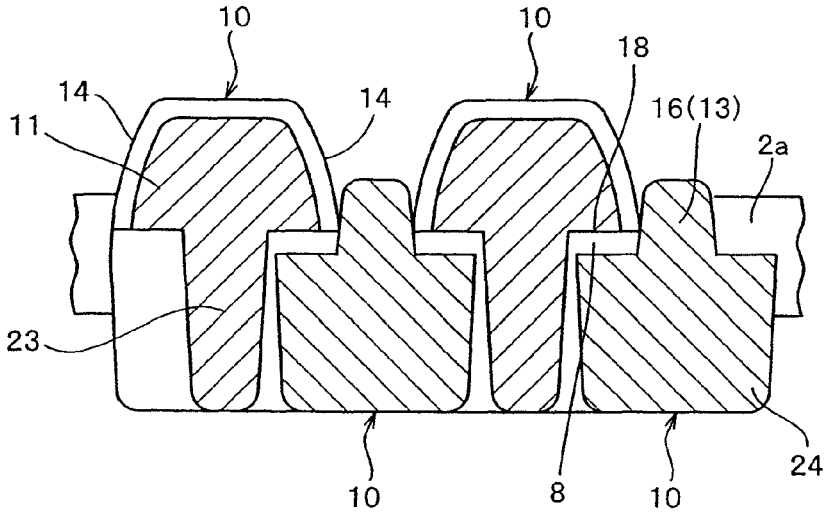
FIG. 7 is a cross-sectional view taken along line VII-VII illustrated in FIG. 6.

FIG. 1 is an enlarged main part perspective view illustrating a main part of a slide fastener according to a first embodiment. FIG. 2 is a top view of a fastener element, FIG. 3 is a bottom view of the fastener element, FIG. 4 is a side view of the fastener element, and FIG. 5 is a view in which the fastener element is viewed from first and second head portion sides. Further, FIG. 6 is a front view of the slide fastener according to the first embodiment, and FIG. 7 is a cross-sectional view taken along line VII-VII illustrated in FIG. 6.

In the following description, a tape length direction of the fastener tape is defined as a back-forth direction, a tape width direction of the fastener tape is defined as a left-right direction, and a tape front-back direction of the fastener tape is defined as a vertical direction. As for the fastener element, in order to describe a feature of the invention to be easily understood, the tape length direction (the back-forth direction) may be described as the element width direction, and the tape width direction (the left-right direction) may be described as the element length direction.

A slide fastener 1 of the first embodiment includes a pair of left and right fastener tapes 2, a plurality of synthetic resin fastener elements 10 lined on opposing tape side edge portions of the fastener tapes 2, and a slider (not shown) for coupling or decoupling the left and right fastener elements 10 as illustrated in FIGS. 1 and 5.

Each of the left and right fastener tapes 2 includes a core portion 2*a* that bulges in the vertical direction of the fastener tape 2 at an opposing tape side edge, and an element row 3 is formed such that a plurality of fastener elements 10 are injection-molded along the core portion 2*a*, that is, the tape side edge portion at a constant interval.

For example, the fastener element 10 in the first embodiment is formed by injection-molding thermoplastic synthetic resin such as polyamide, polyacetal, polypropylene, or polybutylene terephthalate. The synthetic resin fastener element 10 obtained by the above described method is lighter in weight than the metal fastener element.

Further, the fastener element 10 includes an upper half element portion 11 arranged on a first surface side that is an external surface of the fastener tape 2 and an lower half element portion 21 arranged on a second surface side that is a back surface of the fastener tape 2. The upper half element portion 11 of the fastener element 10 includes a first tape-sandwiching portion 12 that sandwiches the tape side edge portion of the fastener tape 2 together with a second tape-sandwiching portion 22 of the lower half element portion 21 which will be described later and a first head portion 13 of a tapered form that extends toward the outside of the tape from the first tape-sandwiching portion 12.

In the first tape-sandwiching portion 12, an element width dimension in an end edge portion (a lower end portion) of a side that contacts the fastener tape 2 is set to a predetermined size in order to secure fixing strength with the fastener tape 2. In this case, the element width dimension in the lower end portion of the first tape-sandwiching portion 12 is set to, for example, the same size as the element width dimension of the conventional synthetic resin fastener element. Further, for example, as long as the fixing strength with the fastener tape 2 is sufficiently obtained, it may be set to a value smaller than the conventional element width dimension, and it may be set to a value larger than the conventional element width dimension as necessary.

Further, on the first tape-sandwiching portion 12 in the upper half element portion 11 and a part of the first head portion 13 at the first tape-sandwiching portion 12 side, a tapered portion 14 in which a dimension between a front side surface and a rear side surface of the upper half element portion 11 is gradually decreased upward is disposed from a lower end edge of the upper half element portion 11 to an upper surface of the upper half element portion 11. In this case, the front side surface and the rear side surface of the upper half element portion 11 on which the tapered portion 14 is disposed are formed on a curved surface having a small curvature as illustrated in FIG. 5. Further, in the invention, the front side surface and the rear side surface may be formed on a flat plane surface.

In the first embodiment, a tapered angle θ2 of the tapered portion 14 inclined to the element vertical direction as illustrated in FIG. 5 has been set to 10°. As the tapered portion 14 has the tapered angle θ2, a dimension in the tape length direction (that is, the element width dimension) in the upper surface of the first tape-sandwiching portion 12 can be set such that a maximum value W2 of a dimension in the tape length direction of the upper surface of the first tape-sandwiching portion 12 can be smaller than 70% of a maximum value W1 of a dimension in the tape length direction in the first tape-sandwiching portion 12 (that is, the element width dimension in the lower end portion of the first tape-sandwiching portion 12) as illustrated in FIGS. 2 and 5. In the case of the first embodiment, the maximum value W2 has been set to the size of about 62% of the maximum value W1. As a result, the form of each synthetic resin fastener element 10 fixed to the fastener tape 2 can look like the metal fastener element when the slide fastener 1 of the embodiment is viewed from the front surface side.

Further, the first head portion 13 in the upper half element portion 11 extends to the forefront of the lower half element portion 21 and is formed in the tapered form in which a dimension in the tape length direction gradually decreases toward a forefront from a base end portion bonded to the first tape-sandwiching portion 12 of the first head portion 13. The first head portion 13 extends to the forefront of the lower half element portion 21, and thus an appearance of the fastener element 10 can approximate to the metal fastener element. Further, even if force of the tape front-back direction (thrust force) is applied to the fastener elements 10 in a state in which the left and right fastener elements 10 are coupled, it is possible to simply prevent coupling of the fastener elements 10 from being deviated, and the coupling state can be maintained.

Further, the first head portion 13 includes a first narrow width portion 13*a* arranged on the first tape-sandwiching portion 12 side and a second narrow width portion 13*b* arranged on an element forefront side via a bend portion 13*c* from the first narrow width portion 13*a*. For example, when a side edge in the base end portion of the first head portion 13 is connected with a side edge in the forefront of the first head portion 13 by a straight line, the first narrow width portion 13*a* is formed to bulge outside the straight line, and the second narrow width portion 13*b* is formed to be recessed inside the straight line.

By disposing the first narrow width portion 13*a* and the second narrow portion 13*b* in the first head portion 13 as described above, an appearance of each fastener element 10 can further approximate to the metal fastener element. Further, in the first head portion 13, for example, compared to a head in which the element width dimension gradually decreases at the same ratio toward the forefront portion from the base end portion of the head (a head illustrated in a dotted line in FIG. 2), the element width dimension of the second narrow width portion 13*b* from the forefront of the first head portion 13 to the bend portion 13*c* is smaller. Thus, when the slide fastener 1 of the first embodiment which will be described later is bent in a direction in which the adjacent upper half element portions 11 get closer to each other (see FIG. 8), the first head portion 13 can be prevented from interfering the upper half element portion 11 of the other coupling party with a high degree of certainty.

Further, in the first head portion 13, for example, compared to a head in which the element width dimension gradually decreases at the same ratio toward the forefront portion of the head from the base end portion of the head, the element width dimension of the first narrow width portion 13*a* from the bend portion 13*c* to the base end portion of the first head portion 13 is larger. Thus, for example, when the left and right fastener elements 10 are coupled, even if thrust force in which the fastener elements 10 head from the lower side to the upper side is applied to the fastener elements, the first narrow width portion 13*a* supports a second head portion 24 of the other coupling party with a higher degree of certainty, and thus the coupling state of the fastener element 10 can be stably maintained.

Further, in the first embodiment, as illustrated in FIG. 2, an internal angle θ3 in the forefront portion (the second narrow width portion 13*b*) of the first head portion 13 has been set to 20°, and the forefront of the first head portion 13 is formed in the form of the curved surface as if chamfered. As a result, an appearance of the fastener element 10 approximates to the metal fastener element, and thus a sense of beauty of the fastener element 10 can be improved.

Further, in the invention, the internal angle θ3 of the forefront portion of the first head portion 13 refers to an angle of the inside in the case in which, for example, if the forefront portion of the first head portion 13 is formed in the form of the curved surface as in the first embodiment, extended lines are drawn along a front side surface and a rear side surface of portions where the element width dimension decreases at a constant rate at the forefront side of the first head portion 13, and the extended lines cross.

Further, in the upper half element portion 11 of the first embodiment, a thin walled start portion 15 that starts to reduce a height dimension in the vertical direction of the fastener element 10 toward the forefront of the first head portion 13 is set, and a thin walled portion 16 that is smaller in height dimension in the vertical direction of the fastener element 10 than a height dimension of the fastener element 10 in the thin walled start portion 15 is formed from the thin walled start portion 15 to the forefront portion side of the first head portion 13 as an interference avoiding portion which will be described later.

In the first embodiment, the thin walled start portion 15 is set at a position where a dimension L2 of the tape width direction (the element length direction) from the forefront of the first head portion 13 to the thin walled start portion 15 is the size of 45% of a length dimension L1 of the whole fastener element 10.

Further, the thin walled start portion 15 may be set, in accordance with the shape of the fastener element 10, at an appropriate position where the length dimension L2 is equal to or more than 45% of the length dimension L1. However, in order to fulfill a function as the interference avoiding portion with a higher degree of certainty, the thin walled start portion 15 is preferably set at a position of an end edge side of the first tape-sandwiching portion 12 side in the fastener element 10 (that is, an end edge side of the first tape-sandwiching portion 12 opposite to the first head portion 13 side) further than the forefront of the first head portion 13 of the other coupling party when viewed in the tape width direction in a state in which the left and right fastener elements 10 are coupled.

Further, the thin walled portion 16 of the first embodiment has a downward inclined surface 17 that is inclined downward to gradually reduce a height dimension in the vertical direction of the fastener element 10 from the thin walled start portion 15 to the forefront of the first head portion 13. In this case, an inclination angle θ1 at which the downward inclined surface 17 is inclined has been set to 20° on the upper surface of the tape inner side further than the thin walled start portion 15 in the upper half element portion 11.

As a result, in the fastener element 10 of the first embodiment, for example, as illustrated in FIG. 4, a height dimension H2 of the fastener element 10 in the forefront of the first head portion 13 can be set to be equal to or less than 80% of a height dimension H1 of the fastener element 10 at a position where the thin walled start portion 15 is arranged. Further, since the first head portion 13 extends up to the forefront of the lower half element portion 21 with the necessary thickness as described above, the height dimension H2 is set to be larger than 50% of the maximum value H1. Actually, in the case of the first embodiment, the height dimension H2 has been set to the size of about 75% of the maximum value H1.

In the fastener element 10 of the first embodiment, the lower half element portion 21 is formed integrally with the upper half element portion 11. The lower half element portion 21 includes a second tape-sandwiching portion 22 that has a predetermined dimension in the tape length direction and sandwiches the tape side edge portion of the fastener tape 2 together with the first tape-sandwiching portion 12, a neck 23 that extends toward the outside of the tape from the second tape-sandwiching portion 22 and has a shape that is constricted in the front and rear of the tape length direction, and a second head portion 24 that extends from the forefront of the neck 23 and bulges in the front and rear of the tape length direction.

Further, in the lower half element portion 21, as illustrated in FIGS. 2 and 5, a maximum value W3 of a dimension in the tape length direction in the second head portion 24 has been set to the size of 88% of a maximum value W1 of a dimension in the tape length direction of the second tape-sandwiching portion 22. As a result, when the left and right fastener elements 10 are coupled, sufficient coupling strength capable of meeting the use of the slide fastener 1 can be stably obtained, and coupling movement for coupling the left and right fastener elements 10 can be smoothly performed.

Further, in the fastener element 10 of the first embodiment, a step portion 18*a* is disposed in a boundary portion 18 between the upper half element portion 11 and the lower half element portion 21 as illustrated in FIG. 4. In the lower half element portion 21, a height dimension of a portion of the fastener tape 2 side from the step portion 18*a* is set to be larger than that of a portion of an element forefront side from the step portion 18*a*.

By disposing the step portion 18*a* and increasing the height dimension of the lower half element portion 21 of the fastener tape 2 side from the step portion 18*a*, for example, when the left and right fastener elements 10 are coupled as illustrated in FIG. 6 by sliding the slider (not shown), a gap 8 can be formed between the first head portion 13 of the upper half element portion 11 and the second head portion 24 in the fastener element 10 of the other coupling party as illustrated in FIG. 7. For this reason, when the left and right fastener elements 10 are coupled, for example, even if the relative height positions of the left and right fastener elements 10 are mismatched in an element guide passage of the slider, the coupling movement of the fastener elements 10 can be smoothly performed.

The slide fastener 1 of the first embodiment can make an appearance of the fastener element 10 look like the metal fastener element when the slide fastener 1 is viewed from the front since a plurality of synthetic resin fastener elements 10 having the above described configuration are lined at the tape side edge portions of the fastener tapes 2. For this reason, the slide fastener 1 can look stylish or give a snazzy impression and becomes excellent in quality of appearance and design.

Figure 8:
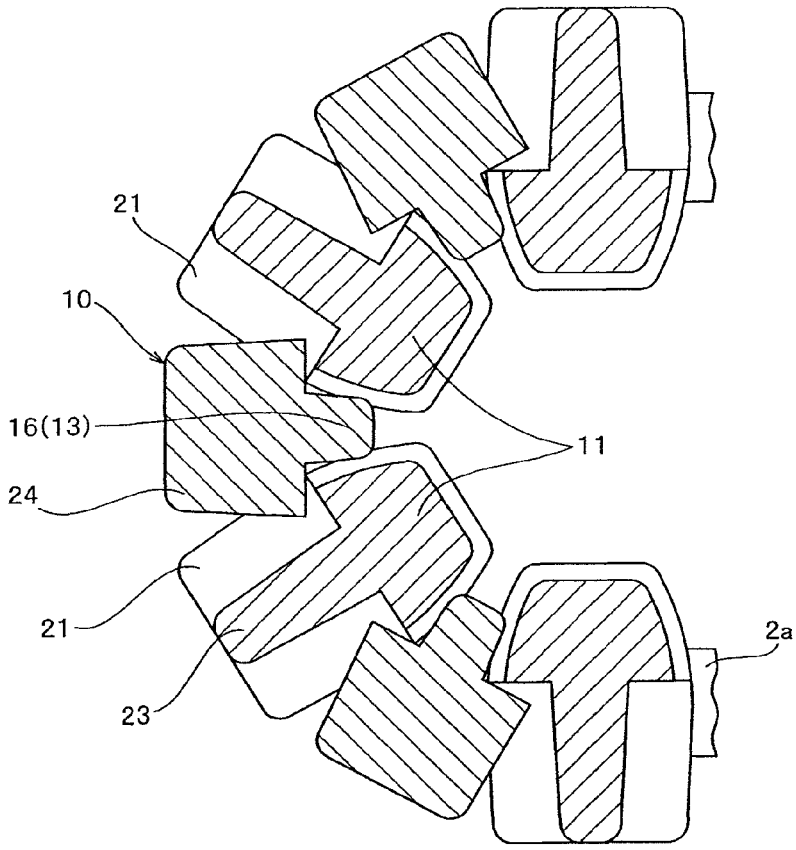
FIG. 8 is a cross-sectional view illustrating a state in which a slide fastener in which left and right fastener elements are coupled is bent.

Further, the slide fastener 1 has the thin walled portion 16 formed in the upper half element portion 11 of the fastener element 10. Thus, when the fastener tape 2 is bent in a direction in which the element upper portions 11 get closer to each other in a state in which the left and right fastener elements are coupled, even if the fastener tape 2 is bent at up to a curvature smaller than the conventional art, since the thin walled portion 16 functions as the interference avoiding portion, it is possible to avoid mutual interference between the first head portion 13 of the fattener element 10 and the upper half element portion 11 of the other coupling party side as illustrated in FIG. 8.

For example, let us assume that the thin walled portion 16 of the first embodiment has not been disposed in the upper half element portion 11. In this case, a height position of the upper surface of the first head portion 13 becomes equal to a height position of the upper portion of the position where the thin walled start portion 15 is arranged. For this reason, when the fastener tape 2 is bent in a direction in which the element upper portions get closer to each other in a state in which the fastener elements are coupled, the first head portion of the upper half element portion and the upper half element portion of the other coupling party side interfere with each other. The interfered portion functions a supporting point, and the lower half element portions 21 of the adjacent fastener elements of the other coupling party side turn in a separation direction. As a result, there has been a problem in that a gap between the second head portions 24 of the fastener elements greatly expands, thus coupling of the left and right fastener elements gets deviated, and chain breaking occurs.

However, in the slide fastener 1 of the first embodiment, the thin walled portion 16 is disposed in the upper half element portion 11 of the fastener element 10 such that the thin walled portion 16 functions as the interference avoiding portion. Thus, when the fastener tape 2 is bent as described above, the upper half element portion 11 of the other coupling party is not interfered by the first head portion 13 of the fastener element 10, the adjacent upper half element portions 11 of the other coupling party side come in contact with each other at the front side edge and the rear side edge of the upper surface side. As a result, the adjacent second head portion portions 24 of the other coupling party side are prevented from being separated until the coupling of the fastener elements 10 gets deviated, and thus the coupling state of the fastener elements 10 can be stably maintained. Therefore, the problem of the above described chain breaking can be solved.

As described above, in the slide fastener 1 of the first embodiment, the fastener element 10 is lighter in weight than the metal fastener element and excellent in quality of appearance like the metal fastener element. Further, even if the fastener tape 2 is bent at up to a curvature smaller than the conventional art in the direction in which the upper half element portions 11 get closer to each other in the state in which the left and right fastener elements 10 are coupled, chain breaking does not occur, and thus the slide fastener 1 becomes a high-quality slide fastener that is also excellent in functionality.

Figure 9:
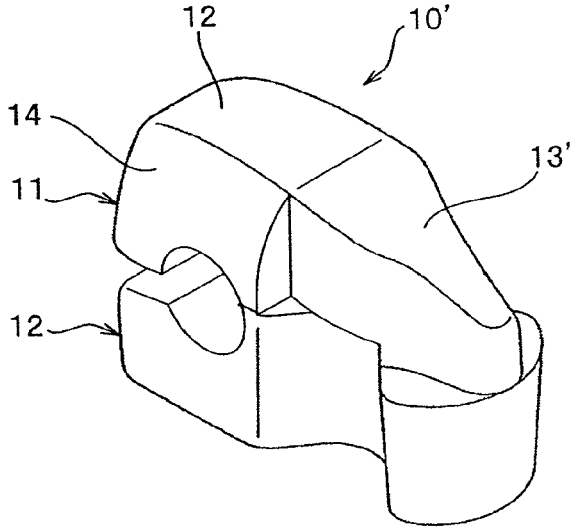
FIG. 9 is a perspective view illustrating a fastener element according to a modified example of the first embodiment.

Further, in the slide fastener 1 of the first embodiment, the tapered portion 14 of the upper half element portion 11 is arranged in the first tape-sandwiching portion 12 and a part of the first head portion 13 at the first tape-sandwiching portion 12 side. However, in the invention, the tapered portion 14 of the upper half element portion 11 may be arranged in at least the first tape-sandwiching portion 12. For example, as in a fastener element 10' illustrated in FIG. 9 that is a modified example of the first embodiment, the tapered portion 14 may not be disposed in a first head portion 13', and a front side surface and a rear side surface of the first head portion 13' may be formed as if cut out such that a vertical cross-sectional shape of the first head portion 13' can correspond to a shape of an upper surface. As a result, an appearance of the fastener element 10' is finished like the metal fastener element, and thus the same effects as the fastener element 10 of the first embodiment can be obtained.

Second Embodiment

Figure 10:
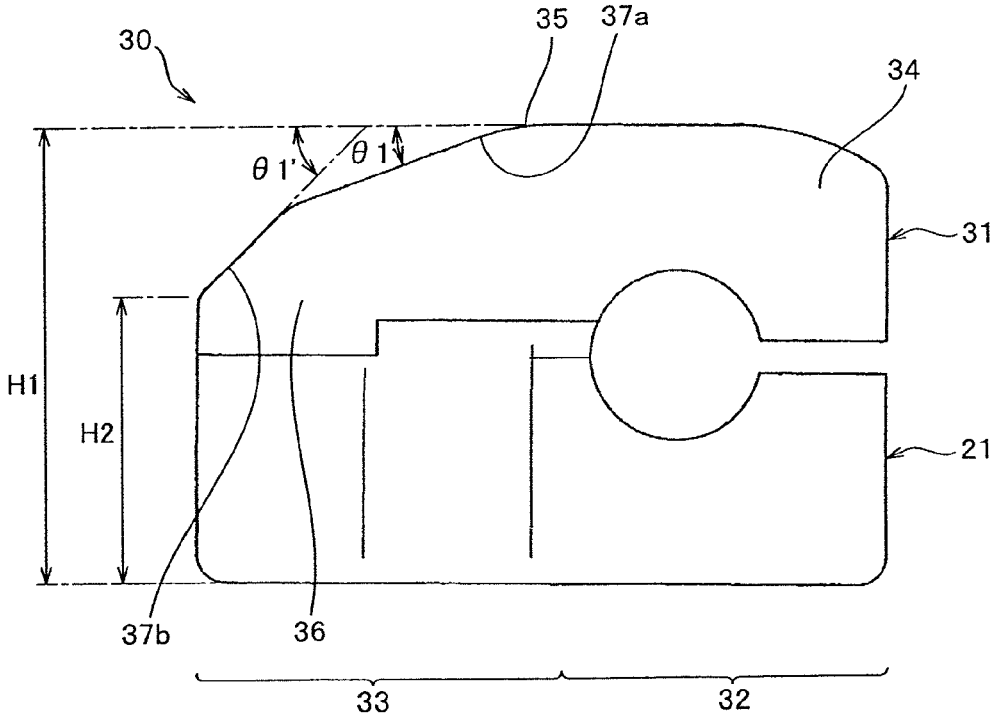
FIG. 10 is a side view illustrating a fastener element used in a slide fastener according to a second embodiment of the invention.

FIG. 10 is a side view illustrating a fastener element used in a slide fastener according to a second embodiment of the invention.

The slide fastener according to the second embodiment and a slide fastener according to a third embodiment which will be described later have substantially the same configuration as in the first embodiment except that a form of an upper half element portion of each fastener element is different from the slide fastener 1 of the first embodiment. Thus, in the second embodiment and a third embodiment which will be described later, the same members as the members described in the first embodiment are denoted by the same symbols, and thus a description thereof will not be repeated.

In the second embodiment, an upper half element portion 31 of the fastener element 30 includes a first tape-sandwiching portion 32 that sandwiches the tape side edge portion of the fastener tape 2 together with the second tape-sandwiching portion 22, and a first head portion 33 of a tapered form that extends toward the outside of the tape from the first tape-sandwiching portion 32. The same tapered portion 34 as in the first embodiment is disposed in the first tape-sandwiching portion 32 and a part of the first head portion 33 at the first tape-sandwiching portion 32 side.

Further, in the upper half element portion 31, a thin walled start portion 35 that starts to reduce a height dimension of the fastener element 30 toward the forefront of the first head portion 33 is set at a position where the dimension L2 of the tape width direction from the forefront of the first head portion 33 to the thin walled start portion 35 is the size of 45% of the length dimension L1 of the whole fastener element 30. A thin walled portion 36 is formed from the thin walled start portion 35 to the forefront side of the first head portion 33 as an interference avoiding portion.

Further, the thin walled portion 36 of the second embodiment includes a first downward inclined surface 37*a* that is inclined downward toward the forefront of the first head portion 33 from the thin walled start portion 35 and a second downward inclined surface 37*b* having an inclination angle θ1' larger than an inclination angle θ1 of the first downward inclined surface 37*a* at the forefront side of the first head portion 33 further than the first downward inclined surface 37*a*.

In this case, the inclination angle θ1 of the first downward inclined surface 37*a* has been set to 20°, and the inclination angle θ1' of the second downward inclined surface 37*b* has been set to 40°. As a result, in the second embodiment, a height dimension H2 of the fastener element 30 in the forefront of the first head portion 33 has been set to the size of about 62% of a height dimension H1 of the fastener element 30 at a position where the thin walled start portion 35 is arranged.

In the slide fastener of the second embodiment having the above-described fastener element 30, the fastener element 30 is lighter in weight than the metal fastener element and is excellent in quality of appearance like the metal fastener element.

In addition, in the slide fastener, similarly to the slide fastener of the first embodiment, even if the fastener tape 2 is bent in the direction in which the upper half element portions 31 get closer to each other in the state in which the left and right fastener elements 30 are coupled, since the thin walled portion 36 disposed in the fastener element 30 functions as the interference avoiding portion, chain breaking is prevented, and thus the coupling state can be stably maintained.

Third Embodiment

Figure 11:
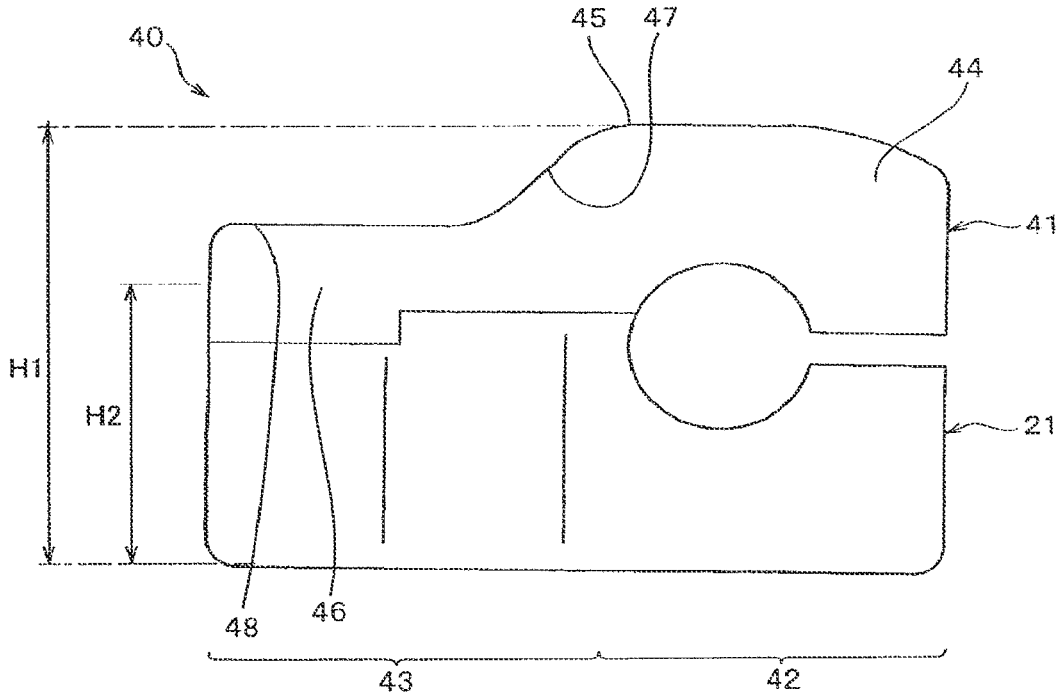
FIG. 11 is a side view illustrating a fastener element used in a slide fastener according to a third embodiment of the invention.
Figure 12:
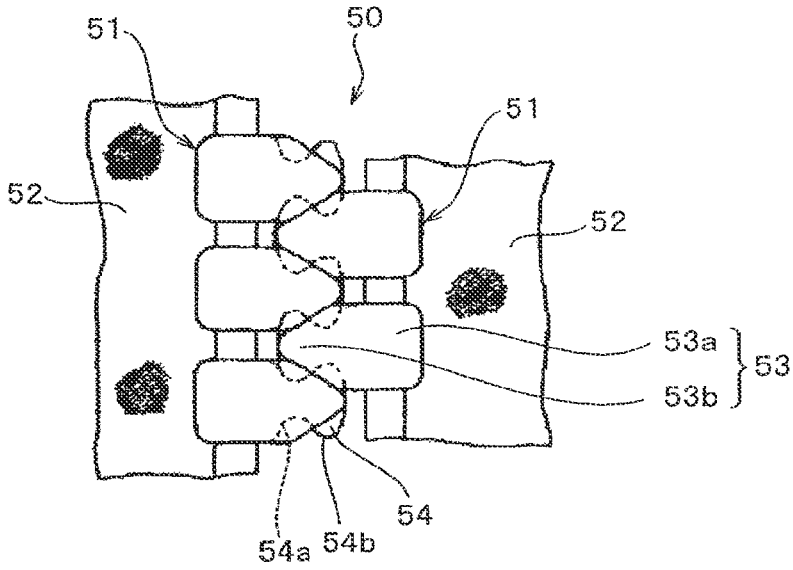
FIG. 12 Prior Art
FIG. 12 is a front view illustrating a slide fastener having a conventional synthetic resin fastener element.
Figure 13:
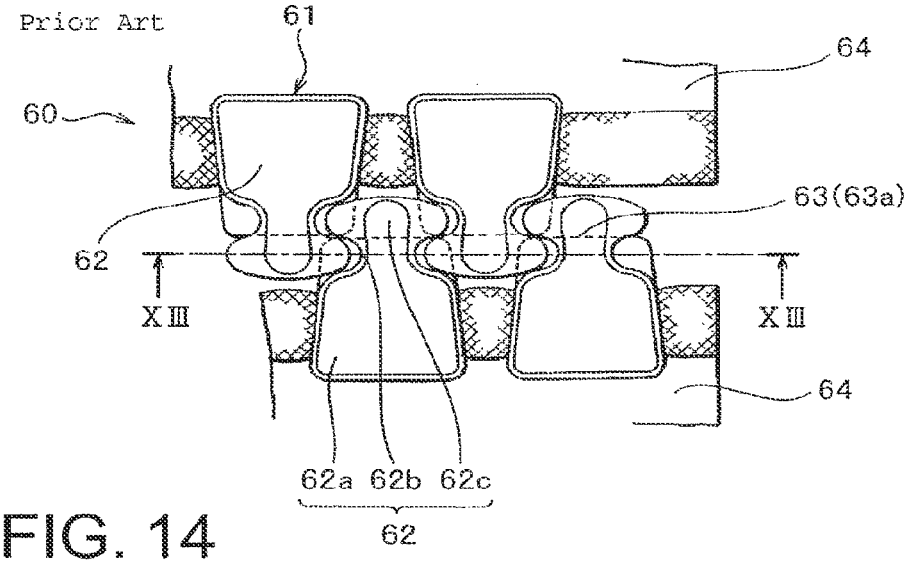
FIG. 13 Prior Art
FIG. 13 is a front view illustrating another slide fastener having a conventional synthetic resin fastener element.
Figure 14:
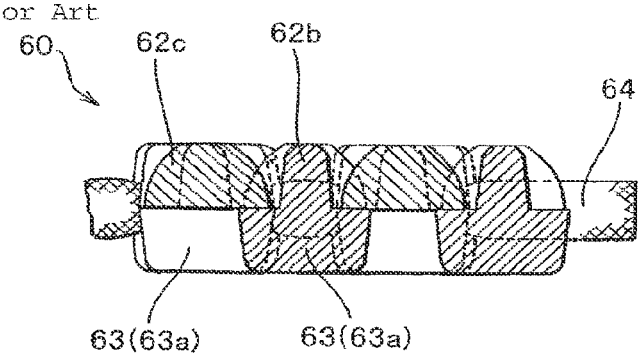
FIG. 14 Prior Art
FIG. 14 is a cross-sectional view taken along line XIII-XIII illustrated in FIG. 13.
Figure 15:
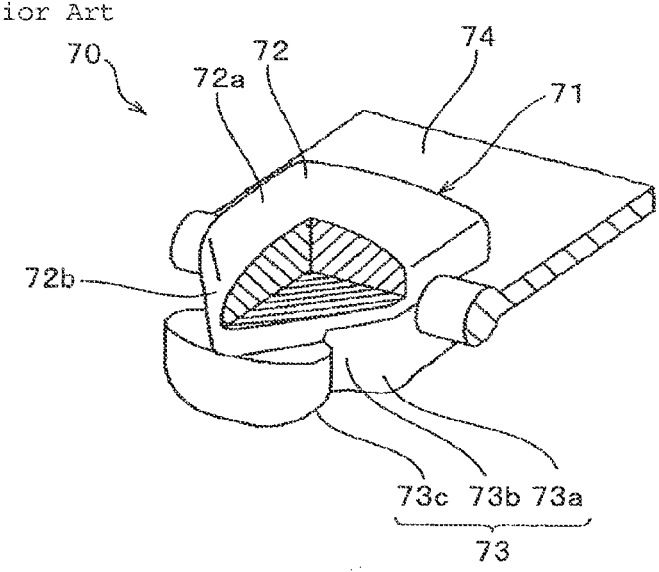
FIG. 15 Prior Art
FIG. 15 is an enlarged main part perspective view illustrating another slide fastener having a conventional synthetic resin fastener element.

FIG. 11 is a side view illustrating a fastener element used in a slide fastener according to a third embodiment of the invention.

An upper half element portion 41 of a fastener element 40 in the third embodiment includes a first tape-sandwiching portion 42 and a first head portion 43 of a tapered form. The same tapered portion 44 as in the first embodiment is disposed in the first tape-sandwiching portion 42 and a part of the first head portion 43 at the first tape-sandwiching portion 42 side. Further, in the upper half element portion 41, a thin walled start portion 45 is set at the same position as in the first and second embodiments, and a thin walled portion 46 is formed from the thin walled start portion 45 to the forefront side of the first head portion 43 as the interference avoiding portion.

The thin walled portion 46 of the third embodiment includes a downward inclined surface 47 that is inclined downward toward the forefront of the first head portion 43 from the thin walled start portion 45, and a flat surface 48 arranged at the forefront side of the first head portion 43 further than the downward inclined surface 47. In this case, an inclination angle θ1 of the downward inclined surface 47 has been set to 40°. Further, a height dimension H2 of the fastener element 40 in the forefront of the first head portion 43 has been set to the size of about 76% of a height dimension H1 of the fastener element 40 at a position where the thin walled start portion 45 is arranged.

Similarly to the first and second embodiments, the slide fastener of the third embodiment having the above-described fastener element 40 is light in weight and excellent in quality of appearance like the metal fastener element. In addition, even if the fastener tape 2 is bent in the direction in which the upper half element portions 41 get closer to each other in the state in which the left and right fastener elements 40 are coupled, chain breaking is prevented, and thus the coupling state can be stably maintained.

The invention claimed is:

1. A slide fastener comprising:

a pair of left and right fastener tapes; and a plurality of synthetic resin fastener elements lined along opposing tape side edge portions of the fastener tapes, each fastener element including an upper half element portion disposed at a first surface side of the fastener tape and a lower half element portion disposed at a second surface side of the fastener tape, the upper half element portion including a first tape-sandwiching portion having a predetermined dimension in a tape length direction, and a first head portion of a tapered form that extends from the first tape-sandwiching portion toward an outside of the tape to a forefront portion of the lower half element portion and has a dimension in the tape length direction that gradually decreases toward the forefront, the lower half element portion including a second tape-sandwiching portion that sandwiches the fastener tape together with the first tape-sandwiching portion, a neck that extends from the second tape-sandwiching portion toward the outside of the tape and has a shape constricted in a front and rear of the tape length direction, and a second head portion that extends from a forefront portion of the neck and bulges in a front and rear of the tape length direction, and wherein the upper half element portion has a tapered portion in which a dimension between front and rear side surfaces of at least the first tape-sandwiching portion in the tape length direction gradually decreases as it goes upward, wherein the upper half element portion has a thin walled portion in which a height dimension of the fastener element at a forefront portion of the first head portion in a vertical direction of the fastener element is smaller than a height dimension of the fastener element at a thin walled start portion, and wherein the thin walled portion includes a downward inclined surface that is continuously inclined downward to gradually decrease in a height dimension of the fastener element from the thin walled start portion to the forefront portion of the first head portion.

2. The slide fastener according to claim 1, wherein the thin walled portion comprises an interference avoiding portion configured to avoid interference between the first head portion and the upper half element portion of an other coupling party side in order to prevent adjacent second head portions of the other coupling party side from being separated until coupling gets loose by interference between the first head portion and the upper half element portion of the other coupling party side when the fastener tape is bent in a direction in which the upper half element portions get closer to each other in a state where the left and right fastener elements are coupled.

3. The slide fastener according to claim 1, wherein the upper half element portion, an inclination angle of the downward inclined surface thereof relative to the upper surface thereof, at a tape inner side which is further inside than the thin walled start portion, is set to be equal to or more than 15° and to be less than 90°.

4. The slide fastener according to claim 1, wherein the height dimension of the fastener element at the forefront of the first head portion is set to be larger than 50% and to be equal to or less than 80% of the height dimension of the fastener element at a position where the thin walled start portion is disposed.

5. The slide fastener according to claim 1, wherein a dimension of a tape width direction from the forefront of the first head portion to the thin walled start portion is set to be equal to or more than 45% of a length dimension of the whole fastener element.

6. The slide fastener according to claim 1, wherein a tapered angle of the tapered portion in an element vertical direction is set to be equal to or more than 5°.

7. The slide fastener according to claim 1, wherein a maximum value of a dimension in a tape length direction of an upper surface of the first tape-sandwiching portion is set to be smaller than 70% of a maximum value of a dimension in a tape length direction of the first tape-sandwiching portion.

8. The slide fastener according to claim 1, wherein an internal angle at a forefront of the first head portion is set to be equal to or less than 30°.

9. The slide fastener according to claim 1, wherein a maximum value of a dimension in a tape length direction of the second head portion is set to be equal to or more than 85% and to be equal to or less than 95% of a maximum value of a dimension in a tape length direction of the second tape-sandwiching portion.

* * * * *

UNITED STATES PATENT AND TRADEMARK OFFICE

CERTIFICATE OF CORRECTION

PATENT NO. : 8,539,650 B2
APPLICATION NO. : 13/144235
DATED : September 24, 2013
INVENTOR(S) : Masayoshi Kojima et al.

It is certified that error appears in the above-identified patent and that said Letters Patent is hereby corrected as shown below:

On Title page, item (75), in "Inventors", in column 1, line 1, Delete "Toyoma" and insert -- Toyama --, therefor.

Signed and Sealed this
Twenty-fifth Day of March, 2014

Michelle K. Lee

Michelle K. Lee
*Deputy Director of the United States Patent and Trademark Office*